US007000731B2

(12) United States Patent
Swiderski et al.

(10) Patent No.: US 7,000,731 B2
(45) Date of Patent: Feb. 21, 2006

(54) MULTI-MATERIAL COVER FOR A LADDER RAIL END

(75) Inventors: Paul R. Swiderski, Georgetown, KY (US); Donald L. Gibson, Pewee Valley, KY (US); Michael S. Gaynor, Clarksville, IN (US); Eric V. Chevalier, Clarksville, IN (US)

(73) Assignee: Louisville Ladder Group, LLC, Louisville, KY (US)

( * ) Notice: Subject to any disclaimer, the term of this patent is extended or adjusted under 35 U.S.C. 154(b) by 211 days.

(21) Appl. No.: 10/207,926

(22) Filed: Jul. 30, 2002

(65) Prior Publication Data

US 2004/0020715 A1 Feb. 5, 2004

(51) Int. Cl.
*E04G 5/02* (2006.01)

(52) U.S. Cl. ..... 182/108; 182/129; 182/214

(58) Field of Classification Search ..... 182/108, 182/107, 129, 214; 248/188.9, 910
See application file for complete search history.

(56) References Cited

U.S. PATENT DOCUMENTS

| | | | | | |
|---|---|---|---|---|---|
| 1,382,833 | A * | 6/1921 | Hurd | 182/108 |
| 1,600,103 | A * | 9/1926 | Evans | 182/108 |
| 2,925,877 | A * | 2/1960 | Wright | 182/108 |
| 3,062,319 | A * | 11/1962 | Wright | 182/108 |
| 3,115,212 | A * | 12/1963 | Keatiey | 182/108 |
| 3,662,856 | A * | 5/1972 | D'Amico et al. | 182/108 |
| 3,693,269 | A * | 9/1972 | Guarrera | 36/15 |
| 3,814,160 | A * | 6/1974 | Creasey | 152/154.2 |
| 4,554,994 | A * | 11/1985 | Weiner | 182/18 |
| 4,726,446 | A * | 2/1988 | Perbix | 182/46 |
| 4,899,848 | A * | 2/1990 | Parr | 182/108 |
| 5,131,495 | A * | 7/1992 | Bartnicki et al. | 182/124 |
| 5,141,076 | A * | 8/1992 | Joyce et al. | 182/108 |
| 5,303,756 | A * | 4/1994 | Hill | 152/154.2 |
| 5,366,051 | A * | 11/1994 | Bartnicki et al. | 182/46 |
| 5,427,342 | A * | 6/1995 | Gagnon | 248/188.9 |
| 5,533,591 | A * | 7/1996 | Kiska | 182/108 |
| 5,791,435 | A * | 8/1998 | Garnett | 182/107 |
| 5,833,028 | A * | 11/1998 | Ramsey et al. | 182/129 |
| 6,006,863 | A * | 12/1999 | LeGrand et al. | 182/129 |
| 6,220,199 | B1 * | 4/2001 | Williams | 116/208 |
| 6,499,563 | B1 * | 12/2002 | Bremick | 182/108 |
| 6,547,036 | B1 * | 4/2003 | Carter | 182/200 |
| 6,755,281 | B1 * | 6/2004 | Saputo et al. | 182/118 |
| 6,761,340 | B1 * | 7/2004 | Shaw | 248/188.9 |
| 2003/0188926 | A1 * | 10/2003 | Crain | 182/166 |
| 2004/0011590 | A1 * | 1/2004 | Quick | 182/108 |

(Continued)

FOREIGN PATENT DOCUMENTS

| | | | | |
|---|---|---|---|---|
| GB | 2057040 | * | 3/1981 | 182/108 |

OTHER PUBLICATIONS

U.S. Patent Application for "Methods of Manufacturing Multi-Material Covers for Ladder Rail Ends" of Paul R. Swiderski, et al., filed Jul. 30, 2002, U.S. Appl. No. 10/208, 132.

*Primary Examiner*—Bruce A. Lev
(74) *Attorney, Agent, or Firm*—Egbert Law Offices

(57) ABSTRACT

A cover for an end of a ladder rail includes a shell and a tread. The shell comprises at least one material, whereas the tread comprises at least one other material. The shell is sized to engage the ladder rail. The tread is engaged with the shell at least partially by at least one bond, which comprises at least a portion of the shell and at least a portion of the tread.

20 Claims, 9 Drawing Sheets

U.S. PATENT DOCUMENTS

2004/0020582 A1 * 2/2004 Swiderski et al. ..... 156/92
2004/0048708 A1 * 3/2004 Nonnast et al. ..... 474/260
2004/0154865 A1 * 8/2004 Woodward ..... 182/108
2005/0011702 A1 * 1/2005 Zeaman ..... 182/108

* cited by examiner

MULTI-MATERIAL COVER FOR A LADDER RAIL END

FIELD OF THE INVENTION

The present invention relates generally to ladders, and more particularly to covers for ladder rail ends, such as ladder boots and ladder shoes.

BACKGROUND OF THE INVENTION

Many different types of ladders exist and are being used for accessing relatively high otherwise out-of-reach areas. Indeed, ladders of all sorts, such as stepping stools, extension ladders, portable ladders, shelf ladders, among others, are now being used in many different residential, industrial and commercial applications around the world for various purposes.

Although ladders work well for the great number of persons using them, ladders are unfortunately involved in a great number of injuries and even fatalities. These mishaps may result from among other things, falls, falling objects, structural instability, electrocution and overloading.

Partly in an effort to eliminate or at least minimize these hazards, the American National Standards Institute (ANSI) has set certain safety standards for ladders. More specifically, ANSI promotes and publishes voluntary consensus standards and safe use guidelines for many products, including ladders. In the case of ladders, ANSI standards provide detailed specifications on the various materials, construction requirements, test requirements, usage guidelines, and labeling/marking requirements for ladders. For example, ANSI has set forth certain skid resistance requirements for ladders in an effort to reduce the likelihood of ladders skidding or slipping across the surfaces upon which they are being used. Consequently, ANSI standards are an important consideration whenever a ladder is being designed or manufactured.

Another important design criterion for ladders is longevity and their resistance to damage. Thus, ladders are typically made of hard materials which tend to prolong their useful life. However, because hard materials often are associated with relatively low coefficients of friction, ladder rails typically fail to satisfy the ANSI skid resistance requirements. To allow for an ANSI-compliant ladder rail, among other reasons, the end of a ladder rail is usually covered with either a ladder boot or a ladder shoe, either of which provides increased skid resistance for the ladder rail.

Although current ladder boots and ladder shoes are both able to increase a ladder rail's skid resistance, they are not without their drawbacks. For example, existing ladder boots are made from a single material, which is usually a soft material such as polyvinyl chloride (PVC), having a relatively high coefficient of friction associated therewith. Unfortunately, however, soft materials are more susceptible to wear and tear such that ladder boots made therefrom have relatively short useful lives. Indeed, a ladder boot made of a soft material can be worn down in an especially short period of time if the ladder boot is frequently dragged across a floor when the ladder is being moved. Once the ladder boot is sufficiently worn, the ladder boot should be timely replaced otherwise a ladder user may fall should the ladder having a worn ladder boot thereon slip or skid across the floor. The frequent replacement of ladder boots, however, can involve significant amount of time being lost and substantial costs.

Another problem associated with existing ladder boots is that a substantial portion of the ladder rail will be hidden under or covered by the ladder boot. Consequently, the process of inspecting a ladder rail for wear and tear, stress cracks, and other damage can be rather time-consuming and cumbersome in that the ladder boot must first be removed for the inspection and then put back on the ladder rail after the inspection. Indeed, this problem is even exacerbated for a prudent ladder user who inspects the ladder rails for damage before each use of the ladder and anytime after the ladder has been dropped. Moreover, the cumbersomeness of such a process may even cause some ladder users to unwisely forego the ladder rail inspection altogether, which in turn could lead to additional workplace accidents.

With regard to ladder shoes, the typical ladder shoe only covers a minimal or diminutive portion of the ladder rail and thus provides rather limited coverage protection to the end of the ladder rail. Consequently, ladder rails equipped with existing shoes can easily become and often are damaged, for example, when dragged across a floor.

Although some existing ladder shoes have components which are made out of more than one material, the various components of the ladder shoes are attached to each other by one or more mechanical fasteners, such as rivets. Consequently, during the production of the existing multi-component ladder shoes, the additional step of mechanically fastening the components to each other is required, which tends to reduce manufacturing efficiency and increase production costs. In addition, the upper portion of existing multi-component ladder shoes is typically made from an electrically conductive material, such as aluminum, which can thus expose the ladder user to the risk of electrocution.

SUMMARY OF THE INVENTION

Accordingly, a need remains in the art for a ladder rail end cover, such as a ladder boot or a ladder shoe, and a method of manufacturing the same, wherein the cover at least maintains the slip or skid resistance of a ladder rail and also protects a portion of the ladder rail. The ladder rail on which the cover is placed should be compliant with the ANSI skid resistance requirements. The cover should not be overly susceptible to wear and tear. Ideally, the cover would allow a user to adequately inspect the ladder rail without requiring the removal of the cover from the ladder rail. Moreover, the method of manufacturing should allow the cover to be produced in a relatively efficient and economical fashion.

In one form, the present invention provides a cover for an end of a ladder rail. The cover comprises a shell and a tread. The shell comprises at least one material, whereas the tread comprises at least one other material. The shell is sized to engage the ladder rail. The tread is engaged with the shell at least partially by at least one bond, which comprises at least a portion of the shell and at least a portion of the tread.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will be more fully understood from the detailed description and the accompanying drawings, wherein.

DETAILED DESCRIPTION OF THE PREFERRED EMBODIMENTS

Figure 1:
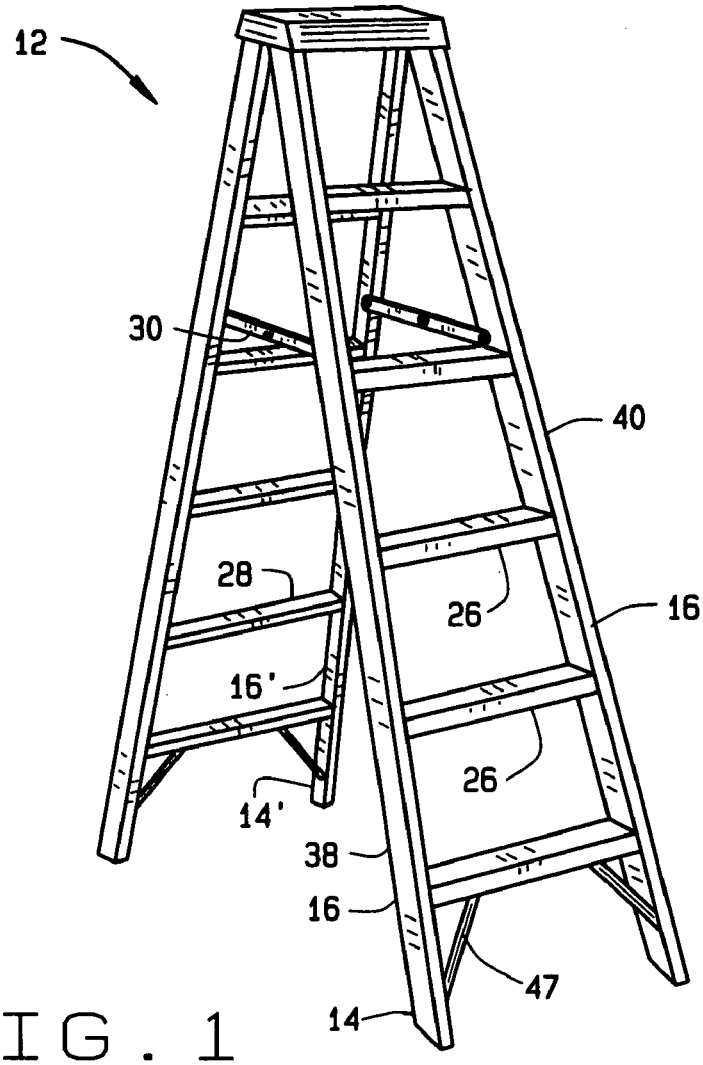
FIG. 1 is a perspective view of a stepladder.

The following description of the preferred embodiments is merely exemplary in nature and is in no way intended to limit the invention, its application, or uses. For example, the term "ladder" as used herein shall be construed by those skilled in the art to be any of a wide range of climbing related apparatus, such as stepping stools, hoop stools, stepladders, shelf ladders, extension ladders, library ladders, portable ladders, single ladders, warehouse ladders, among others. Likewise, the term "cover" as used herein shall be construed by those skilled in the art to include both ladder boots and ladder shoes. Accordingly, the specific reference to ladder and cover herein should not be construed as limiting the scope of the present invention. Moreover, the present invention should also not be limited to the particular stepladder generally indicated by reference number 12 in FIG. 1 or to ladder rails having the particular cross section generally indicated by reference number 16 in FIG. 2.

In addition, certain terminology will also be used in the following description for the purpose of reference only, and thus are not intended to be limiting. For example, terms such as "upper", "lower", "above", and "below" refer to directions in the drawings to which reference is made. Terms such as "front", "back", "rear", and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

Figure 3:
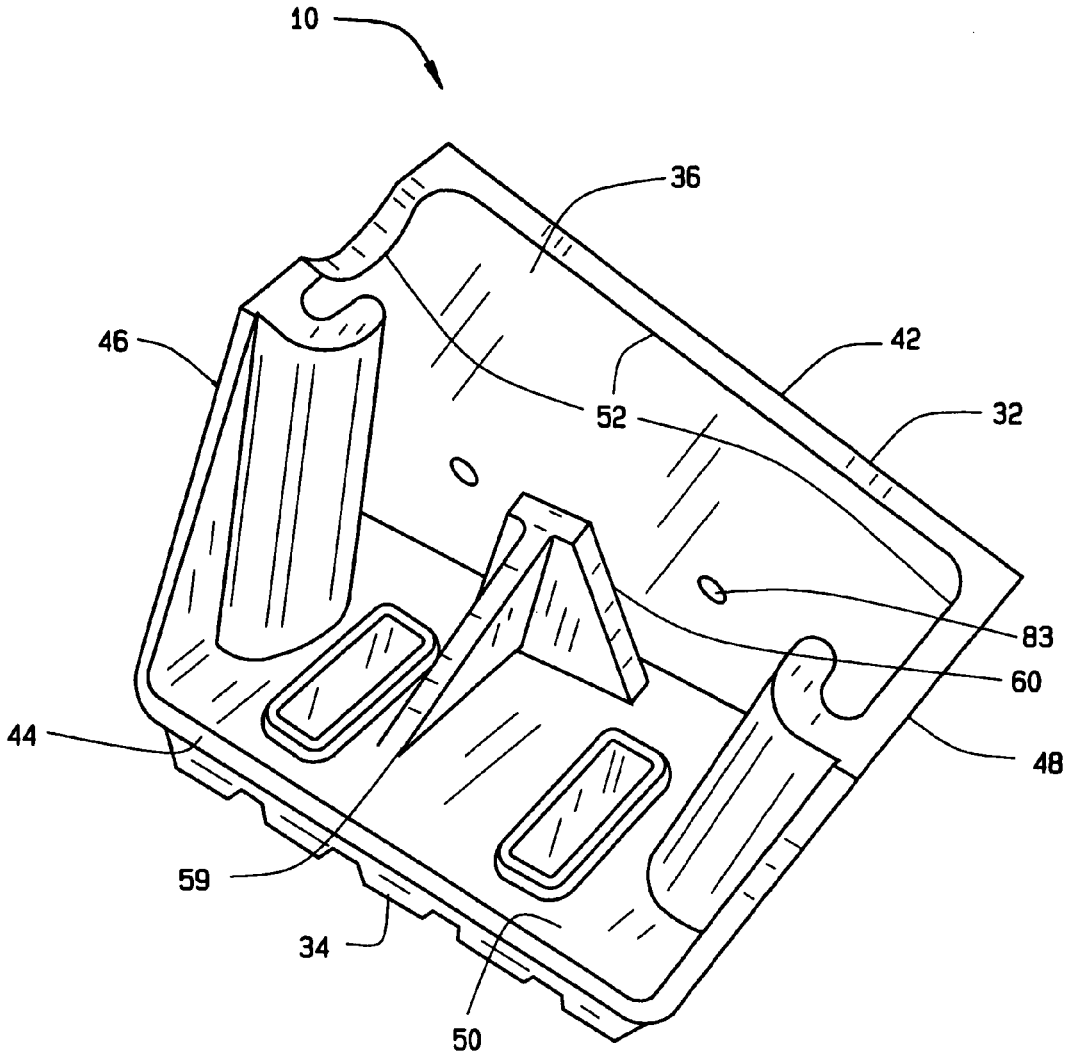
FIG. 3 is inward side perspective view of a cover for an end of a ladder rail constructed in accordance with the principles of the present invention.
Figure 4:
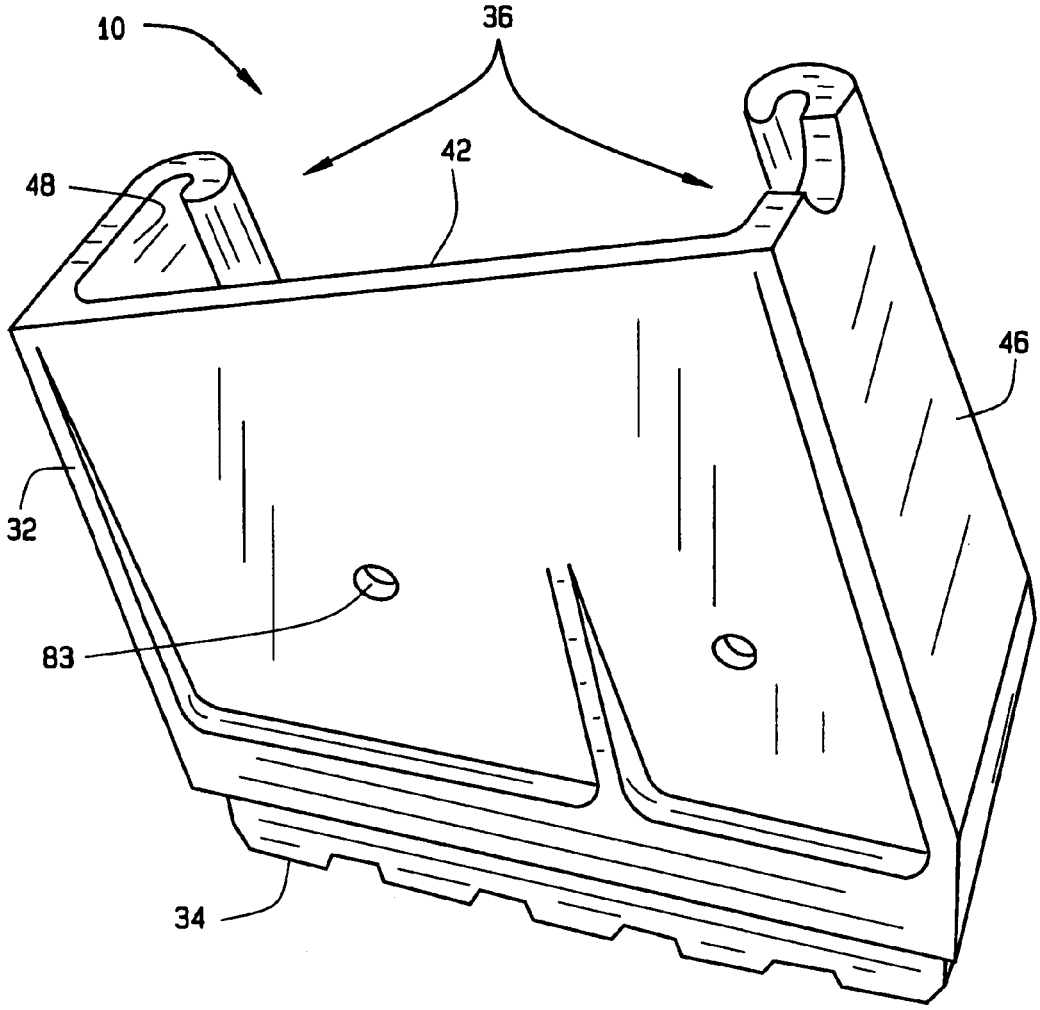
FIG. 4 is an outward side perspective view of the cover shown in FIG. 3.

Referring now to the drawings, a cover according to the present invention is generally indicated by reference numeral 10 in FIG. 3. The cover 10 may be used with the stepladder 12 shown in FIG. 1. The typical stepladder 12 in which the cover 10 may be used may comprise any of a wide range of stepladders now known in the art or that may be developed in the future. Even though stepladders are well-known in the art, however, a brief description of the stepladder 12 will be given in order to provide a more understandable basis for understanding the present invention.

As shown in FIG. 1, the stepladder 12 comprises two front legs or ladder rails 16 and two back legs or ladder rails 16'. The back ladder rails 16' are pivotally mounted to the front ladder rails 16, which allows the stepladder 12 to be either opened for use (as shown in FIG. 1) or closed (i.e., collapsed) for storage, transport, etc. (not shown).

The stepladder 12 may be provided with any convenient number of steps, rungs or cleats 26 on which a ladder user may step while ascending or descending. The steps 26 are each positioned between the front ladder rails 16.

The stepladder 12 further includes one or more cross struts or braces (e.g., cross struts 28) between the back ladder rails 16'. The stepladder 12 may also include one or more spreader struts or braces (e.g., spreader braces 30) on each side (i.e., left hand side 38, right hand side 40) between each respective pair of the front and back ladder rails 16 and 16'.

Figure 2:
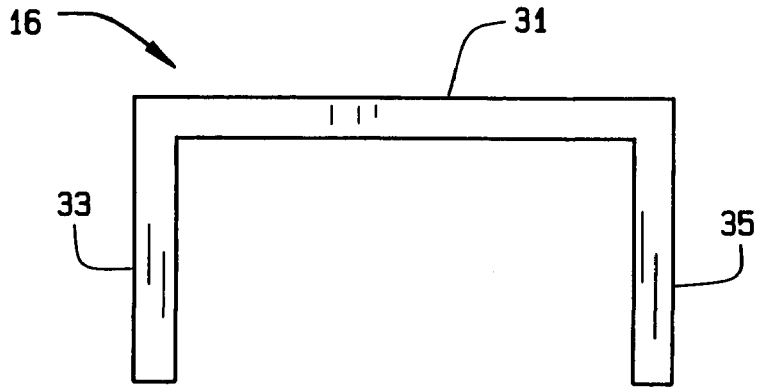
FIG. 2 is an end view of a ladder rail.

As shown in FIG. 2, the ladder rail 16 may comprise a web or connecting portion 31, a first leg or flange 33 extending from one end of the web 31, and a second leg or flange 35 extending from the other end of the web 31. Accordingly, the ladder rail 16 in the illustrated embodiment has a generally u-shaped cross-section, although other configurations are possible as would be obvious to those having ordinary skill in the art.

The various components comprising the stepladder 12 may be made from any of a wide range of metallic and nonmetallic materials (e.g., aluminum, plastics, fiberglass, wood, etc.), and the same material need not be used for each component. However, the applicable ANSI safety standards should be considered when selecting the material(s) for the stepladder 12. In one embodiment, for example, the stepladder 12 rails are made of fiberglass and comprises an FS1500 Series Advent Fiberglass Stepladder currently available from the Louisville Ladder® Group, LLC of Louisville, Ky.

The previous description of the stepladder 12 was provided for illustrative purposes only. Indeed, the present invention can be used with any of wide range of ladders now known or developed in the future. Consequently, the present invention should not be regarded as limited to the particular stepladder 12 shown and described herein.

Regardless of the particular stepladder 12 in which the cover 10 is used, the cover 10 comprises a first portion or shell 32 and a second portion or tread 34, as shown in FIG. 3. The tread 34 is engaged with the shell 32, in a manner that is described in greater detail below, so that at least a portion (e.g., the lower surface 37) of the tread 34 contacts a surface supporting the ladder rail 16 when the shell 32 and the ladder rail 16 are engaged.

Briefly, the shell 32 may be manufactured from at least one material, whereas the tread 34 may be manufactured from at least one other material. Accordingly, the present invention allows materials having certain characteristics and properties to be independently selected for or tailored to the specific functions of the shell 32 and the tread 34. For example, a hard durable material is preferably selected for the shell 32, whereas a softer more skid-resistant material is preferably selected for the tread 34. It should be noted, however, that the shell 32 and tread 34 need not comprise entirely different materials. That is, the shell 32 and tread 34 may each comprise a common material so long as the shell 32 or the tread 34 also comprises at least one other material different from the common material.

Regardless of which materials are ultimately selected for the cover 10, the shell 32 defines an opening 36 sized to receive the end 14 of the ladder rail 16. In the illustrated embodiment, the opening 36 is sized to receive the end 14 of the front ladder rail 16 of an FS1500 Series Advent Fiberglass Stepladder that is shown in FIG. 1 and that is currently available from the Louisville Ladder® Group, LLC of Louisville, Ky. Alternatively, the opening 36 defined by the shell 32 may be sized to receive an end of any of a wide range of other ladder rails now known or developed in the future. For example, in an alternative embodiment 110 described in detail later, the shell 132 defines an opening 136 that is sized to receive the end 14' of a back ladder rail 16' of the FS1500 Series Advent Fiberglass Stepladder.

Before continuing with the description, it should be noted that although it is preferable to equip or provide each ladder rail 16 with a cover, such as the cover 10 or 110, such is not required. It should also be noted that the configuration and orientation of the components of the cover 10 may vary depending on which side (left 38, right 40) of the stepladder 12 the cover 10 will be placed. For example, the cover 10 is shown and described herein in reference to the front ladder rail 16 on the left side 38 of the stepladder 12. As would be obvious to one having ordinary skill in the art, the orientation of the components comprising the cover 10 may be reversed for a cover configured for placement on the front ladder rail 16 on the right side 40 of the stepladder 12. The various components of the cover when configured for the right side 40, however, may be essentially identical to the corresponding components of the respective cover 10 and are not described in further detail herein.

Continuing now with the description, the shell 32 further comprises at least one wall (e.g., 42, 44, 46, 48, 50). In the illustrated embodiment, the shell 32 includes an exterior wall 42, an interior wall 44, two side walls 46 and 48, and a lower wall or base 50. As best shown in FIG. 3, the walls 42, 44, 46, and 48 are substantially vertical. The walls 42, 44, 46, and 48 also extend substantially along the perimeter of the base 50, and accordingly are perimeter walls. It should be noted, however, that the term "perimeter wall" as used herein also includes a wall that extends substantially along a perimeter even though the wall is disposed slightly inward or slightly outward from the perimeter.

Figure 5:
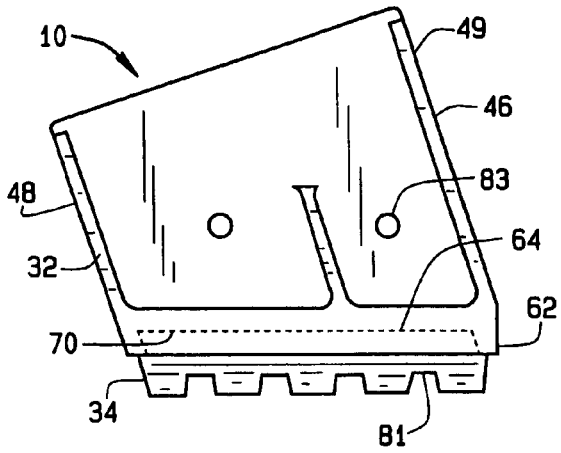
FIG. 5 is an outward side view of the cover shown in FIG. 3.
Figure 6:
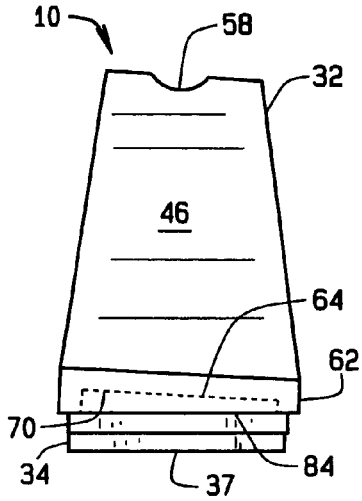
FIG. 6 is a frontward view of the cover shown in FIG. 3.
Figure 7:
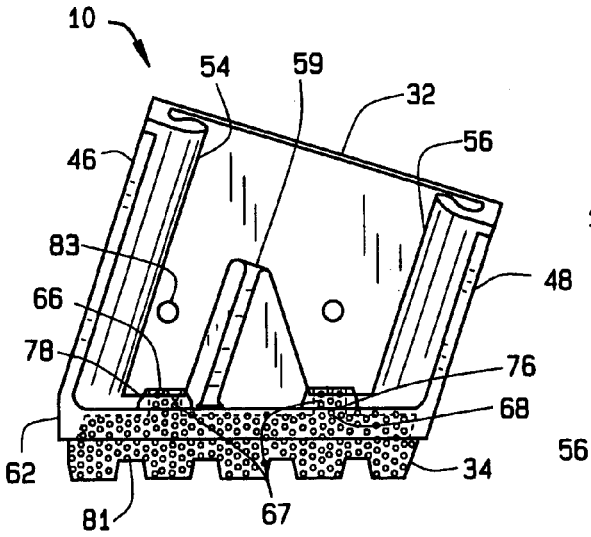
FIG. 7 is an inward side view of the cover shown in FIG. 3.

The side walls 46 and 48, or at least portions thereof, may be slanted to accommodate for the slant of the ladder rail 16 when the stepladder 12 is being used thus allowing the lower surface 37 of the tread 34 to be substantially parallel with or substantially flush against the support surface. As shown in FIGS. 5 through 7, the side wall 48 and at least a portion 49 of the sidewall 46 are slanted to accommodate for the slant of the front ladder rail 16.

Referring back to FIG. 3, the shell 32 may define an interior channel 52 sized to receive at least a portion of the ladder rail 16 therein. In the illustrated embodiment, the exterior wall 42 and two side walls 46 and 48 define a substantially unshaped channel 52. Accordingly, the shell 32 is at least partially disposed around at least a portion of the ladder rail 16 when the end 14 of the ladder rail 16 is received within the opening 36. Alternatively, other configurations are possible for the channel 52, and the configuration may depend at least in part on the configuration of the ladder rail 16 on which the cover 10 is to be used. For example, in another embodiment, the interior wall may extend upwardly beyond the base such that the four walls (exterior, interior, and two side walls) of the shell define a substantially rectangular-shaped channel (not shown).

Figure 8:
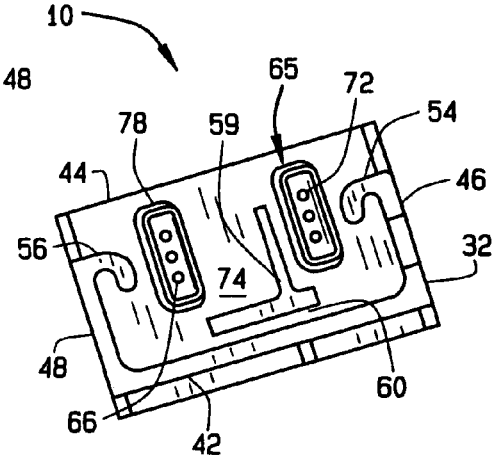
FIG. 8 is an upper view of the cover shown in FIG. 3.
Figure 9:
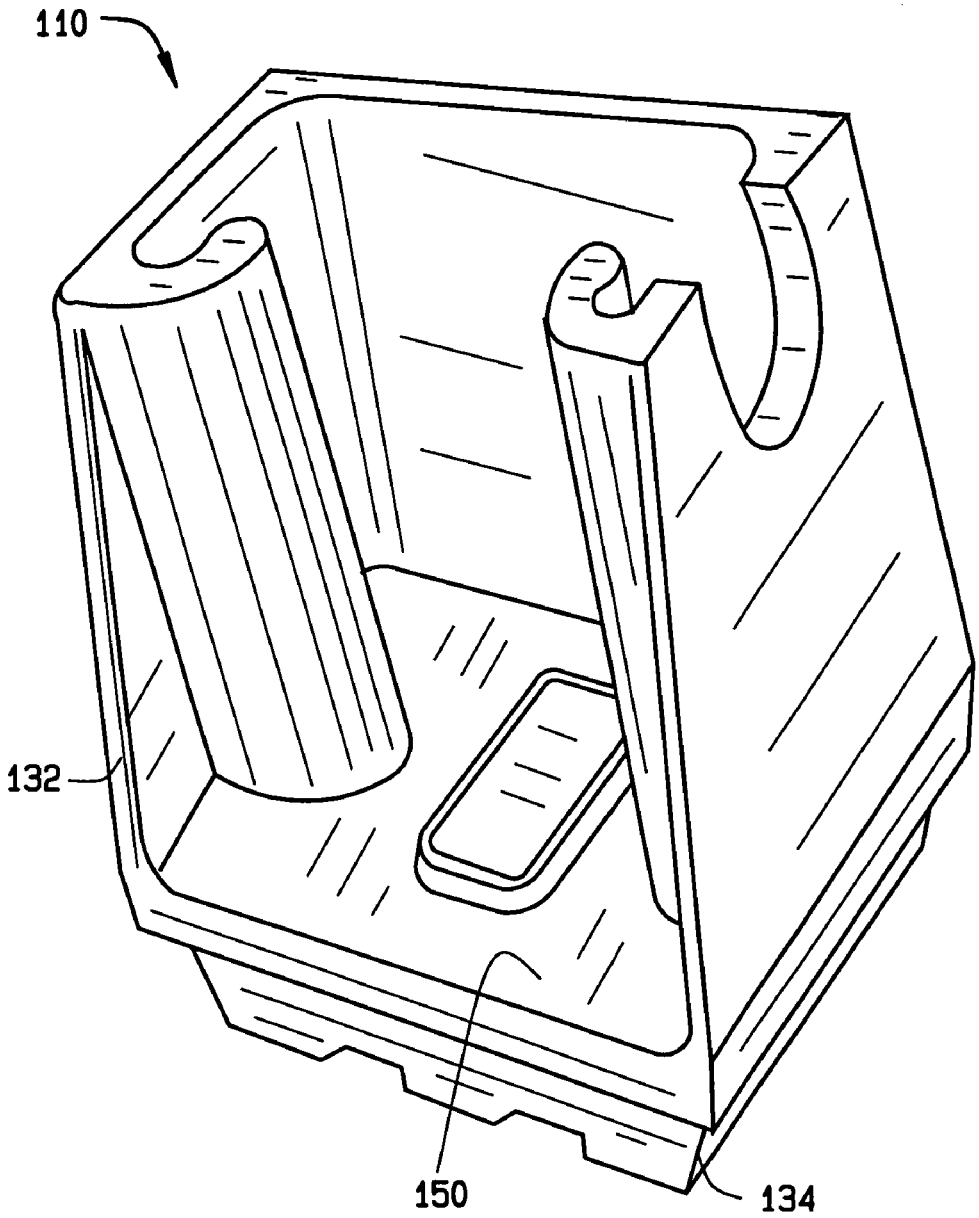
FIG. 9 is an inward perspective view of a second embodiment of a cover constructed in accordance with the principles of the present invention.
Figure 10:
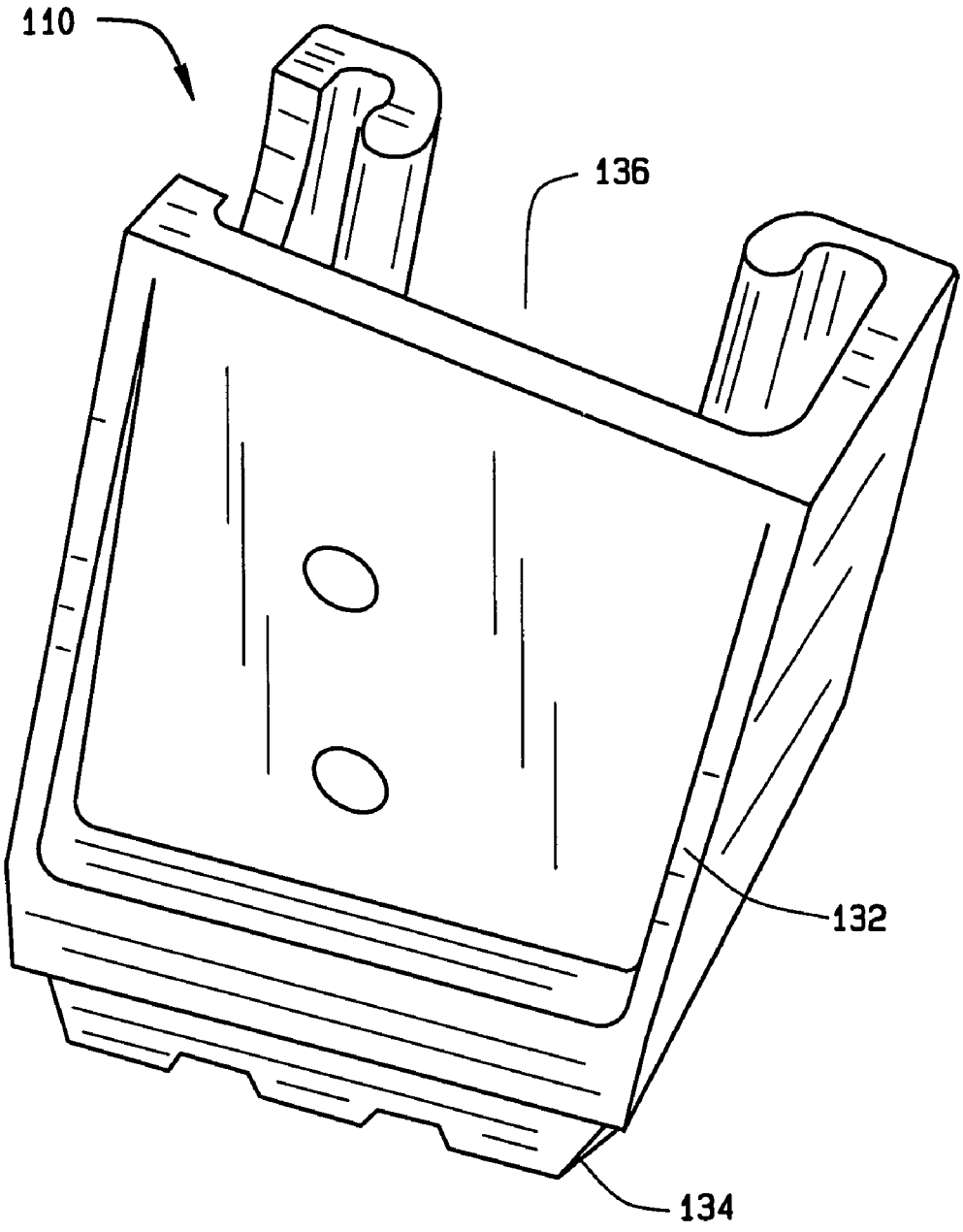
FIG. 10 is an outward side perspective view of the cover shown in FIG. 9.

As shown in FIG. 8, the side wall 46 may include a curl or rail flange retainer 54. Likewise, the other side wall 48 may also include a curl or rail flange retainer 56. When the cover 10 is being placed on the ladder rail 16, the rail flange retainers 54 and 56 engage or wrap around the respectively flanges 33 and 35 of the ladder rail 16, which are shown in FIG. 2. In doing so, the rail flange retainers 54 and 56 assist with the alignment of the ladder rail 16 within the channel 52. In addition, the rail flange retainers 54 and 56 also tend to hinder or impede twisting of the cover 10 with respect to the ladder rail 16 assuming that the rail flanges 33 and 35 are engaged with (i.e., received within) the rail flange retainers 54 and 56, respectively. Furthermore, the rail flange retainers 54 and 56 also cover and thus protect at least portions of the respective rail flanges 33 and 35 when the rail flanges 33 and 35 and rail flange retainers 54 and 56 are engaged.

One or more of the shell walls (e.g., 42, 44, 46, and 48) may be provided with an aperture or opening to provide clearance for any of the various components of the stepladder 12. For example, as best shown in FIG. 6, a cutaway portion 58 is provided in the side wall 46 to provide clearance for one or more mechanical fasteners (e.g., rivets, screws, etc.) that may be used to attach a support gusset or brace 47 (FIG. 1) to the lower step 26.

Referring now to FIGS. 3, 7, and 8, the shell 32 may further includes a web engagement member 59 extending upwardly from the base 50. As shown, the web engagement member 59 is substantially triangularly shaped, although other configurations are possible. The web engagement member 59 and the exterior wall 42 define a slot 60 sized to receive at least a portion of the rail web 31 therein. Accordingly, the engagement of the rail web 31 with the slot 60 allows for ready alignment and then continued alignment of the ladder rail 16 within the channel 52 as the cover 10 is being placed on the ladder rail 16. In addition, the web engagement member 59 also hinders or retards twisting of the cover 10 with respect to the ladder rail 16 when the rail web 31 is engaged with (i.e., received within) the slot 60. The web engagement member 59 also covers and thus protects a portion of the rail web 31 when the rail web 31 is engaged with the slot 60. And finally, in the event that external forces are applied to the cover 10, the web engagement member 59 may absorb at least a portion of the external forces and thus prevent, or at least minimize, the damage that might otherwise be caused to the ladder rail 16 or any mechanical fasteners used to engage the cover 10 and the ladder rail 16 by the external forces.

Preferably, the shell 32 has a substantially open side or face so that a portion of the ladder rail 16 remains exposed or visible even after the cover 10 has been placed over the end 14 of the ladder rail 16. For example, the substantially open face of the shell 32 may comprise a removed portion or a transparent portion (e.g., window). In the illustrated embodiment, the shell 32 has a substantially open interior face in that the interior wall 44 of the shell 32 does not extend upwardly beyond the upper surface 74 of the base 50, the rail flange retainers 54 and 56 do not extend entirely along the respective side walls 46 and 48 thus exposing portions of the respective flanges 33 and 35 when they are engaged with the respective rail flange retainers 54 and 56, and the web engagement member 59 does not extend entirely along the exterior wall 42 thus exposing at least a portion of the web 31 when the web 31 is engaged with the slot 60. Accordingly, the substantially open interior face of the shell 32 should allow a ladder user to adequately inspect the ladder rail 16 for wear and tear, stress cracks, and other damage while the cover 10 remains positioned on the end 14 of the ladder rail 16.

As shown in FIGS. 5 through 7, a lower portion of each of the walls 42, 44, 46 and 48 may extend downwardly below the lower surface 70 of the base 50, thus forming a skirt 62. Accordingly, the skirt 62 covers and thus protects a portion of the tread 34 disposed within the skirt 62 from wear and tear and other damage. For example, the skirt 62 may protect the portion of the tread 34 disposed therein when the end 14 of the ladder rail 16 is being dragged across a surface.

The shell 32 may further define a recessed portion or underside cavity 64 sized to receive at least a portion of the tread 34. As shown, the underside cavity 64 is defined by the skirt 62 and a lower surface 70 of the base 50.

The shell 32 may further include at least one interlocking or mating member, which is generally indicated by reference number 65 in FIG. 8. As described in greater detail later, the shell interlocking member 65 allows a portion 67 (FIG. 7) of the tread 34 to flowingly engage the shell interlocking bond member 65 when the tread portion 67 is in a substantially fluid state. The shell interlocking member 65 also allows the tread portion 67 to remain engaged with the shell interlocking member 65 after the tread portion 67 has substantially solidified, thus allowing for the creation of an interlocking bond between the shell 32 and the tread 34. In other words, an interlocking bond is formed between the shell 32 and the tread 34 by way of the engagement of the tread interlocking or mating member 67 being engaged with the shell interlocking or mating member 65.

In the illustrated embodiment, the shell interlocking or mating member 65 comprises at least one hole 66 and at least one emboss or raised portion 78. More specifically, the base 50 defines six holes 66, although a greater or lesser number may be used. As shown in FIG. 7, each hole 66 includes a first opening 68 defined by the lower surface 70 of the base 50, a second opening 72 defined by an upper surface 74 of the base 50, and a passageway or channel 76 through the base 50 connecting the first and second openings 68 and 72. The upper surface 74 of the base 50 is provided with two embosses 78, each of which is disposed substantially around three of the second openings 72, as shown in FIG. 8.

Figure 17:
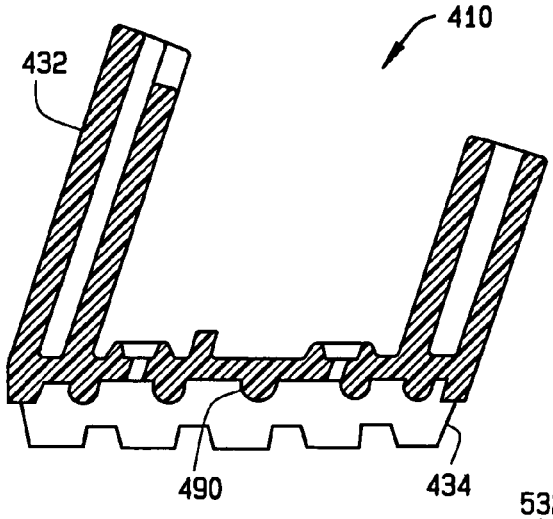
FIG. 17 is a side cross-sectional view of a fifth embodiment of a cover constructed in accordance with the principles of the present invention.
Figure 18:
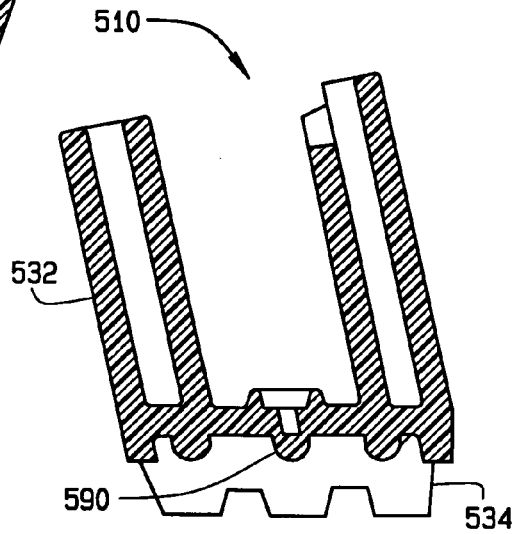
FIG. 18 is a side cross-sectional view of a sixth embodiment of a cover constructed in accordance with the principles of the present invention.
Figure 19:
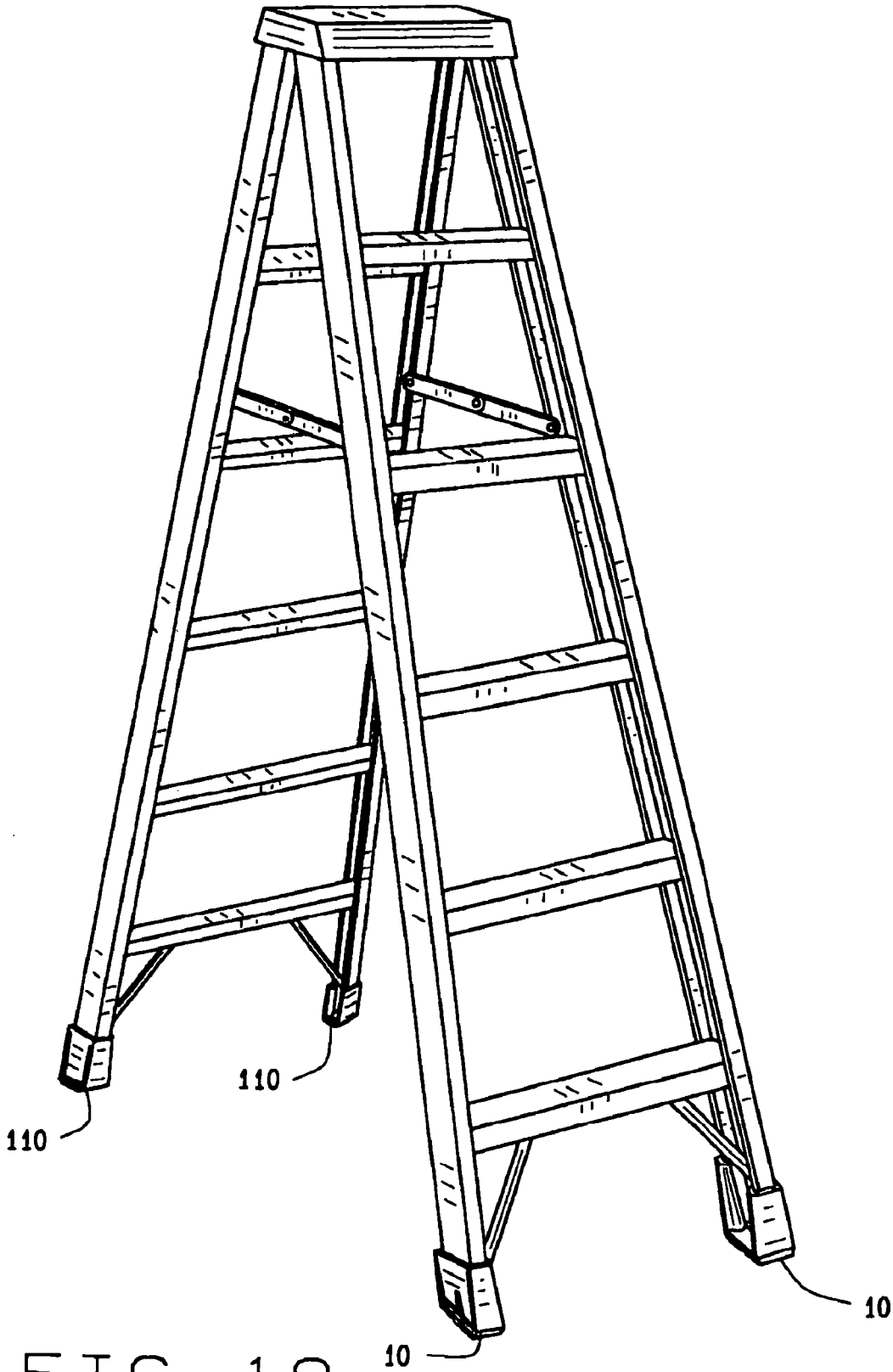
FIG. 19 is a perspective view of an exemplary ladder including covers constructed in accordance with the principles of the present invention.

The shell 32 may further define at least one rib or extended surface within the underside cavity 64. That is, the ribs may extend from the lower surface 70 of the base 50 and/or from the inner surfaces of the lower portion of the walls 42, 44, 46, and 48 that define the skirt 62. Preferably, the ribs do not extend beyond the skirt 62 and thus remain confined within the underside cavity 64, although such is not required. By way of example only, FIGS. 17 and 18 show embodiments of a front and back cover 410 and 510, respectively, wherein the shells 432 and 532 have each been provided with at least one rib or extended surface 490 and 590, respectively. Specifically, the shell 432 has been provided with five (5) ribs 490, whereas the shell 532 has been provided with three (3) ribs 590.

Alternatively, the shell 32 may be provided with any convenient number of suitably sized, shaped, variously arranged and positioned ribs, and such ribs need not each have the same dimensions, shape, configuration, or be arranged in the same manner as that shown in FIGS. 17 and 18. In any event, providing the shell 32 with ribs increases the surface area of the shell material that is available for contacting the tread 34 within the underside cavity 64.

To prevent the shell 32 from falling off or otherwise becoming disengaged from the end 14 of the ladder rail 16, the shell 32 may be removably secured to the ladder rail 16. Although any of a wide range fastening methods, systems and devices may be used to removably secure the shell 32 to the ladder rail 16, the shell 32 is preferably removably secured to the ladder rail 16 in a manner that allows for ready replacement of the cover 10 in the field (i.e., at the place the ladder 12 is being used) and that allows the cover 10 to be readily retrofit onto any of wide range of currently existing ladders with little to no additional tooling. For example, in the illustrated embodiment, the shell 32 defines one or more openings 83 for accommodating one or more screws or rivets that may be used to secure the shell 32 to the ladder rail 16. See FIGS. 3, 4, 5 and 8. Or for example, the shell in another embodiment may be provided with internal ribs that frictionally engage the web 31 and/or rails 33 and 35 of the ladder rail 16 to hold the cover on the end 14 of the ladder rail 16.

Although the shell 32 may comprise any of a wide range of metallic and nonmetallic materials (e.g., fiberglass, wood, natural rubber, synthetic rubber, plastics, polymeric materials, other composite materials, among others), certain materials have properties that are more suitable for the shell 32. For example, the material(s) selected for the shell 32 preferably has properties suitable for protecting the tread 34 and the end 14 of the ladder rail 16 from wear and tear damage and properties suitable for the manufacturing processes that will be used to make the cover 10. In addition, it is generally preferred, but not required, that the shell material comprise a nonconductive or dielectric material to reduce the risk of electrocution to a ladder user. Accordingly, the shell 32 preferably comprises a hard, durable and nonconductive material, such as a plastic or polymeric material. By way of illustration only, the shell material may comprise a polypropylene-polyethylene copolymer from Huntsman® Corporation, Salt Lake City, Utah. It should be noted that other materials may be used for the shell 32 without departing from the spirit and scope of the invention. For example, in other embodiments, it may be preferable to have the shell comprise a conductive material so that static electricity may dissipate to ground and thus prevent the build-up of static electricity in the stepladder 12.

As briefly mentioned earlier, the cover 10 further includes the tread 34, which improves the gripping action of the ladder rail 16 on the support surface. Stated differently, the tread 34 increases the frictional engagement between the ladder rail 16 and the support surface.

Figure 11:
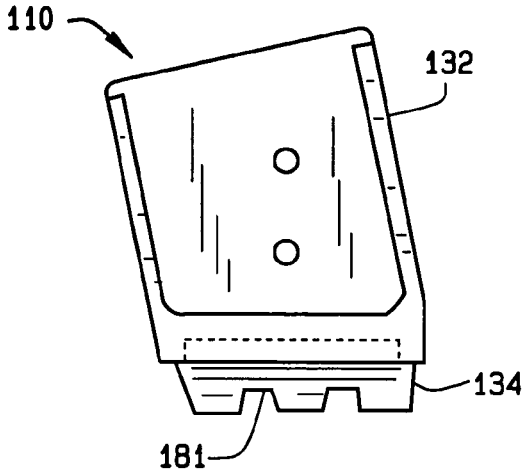
FIG. 11 is an outward side view of the cover shown in FIG. 9.
Figure 12:
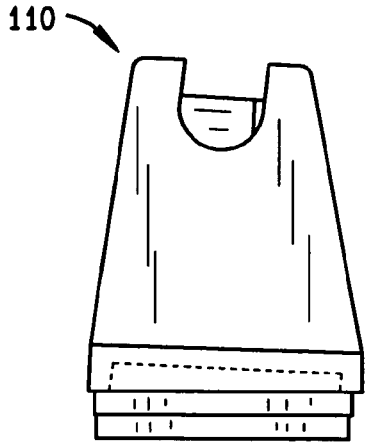
FIG. 12 is a frontward view of the cover shown in FIG. 9.
Figure 13:
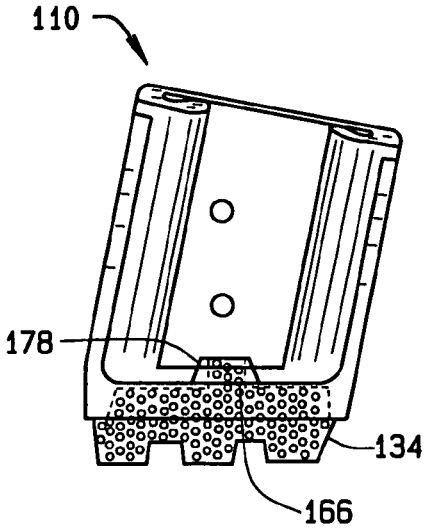
FIG. 13 is an inward side view of the cover shown in FIG. 9.
Figure 14:
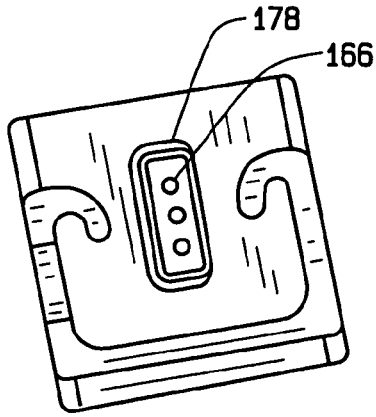
FIG. 14 is an upper view of the cover shown in FIG. 9.

Referring to FIGS. 5 and 7, the tread 34 may include one more tread grooves 81. In the illustrated embodiment, the tread 34 is provided with four tread grooves 81, although a greater or lesser number of tread grooves 81 may be used. For example, FIG. 11 shows an alternative embodiment of the cover 110 in which the tread 134 is provided with two grooves 181. Regardless of the particular number of tread grooves 81 used, the tread grooves 81 should improve the traction or grip that the tread 34 obtains on an uneven surface by improving the conformability of the tread 34 to the uneven surface. In addition, liquids (e.g., water, etc.) and other debris may move into the tread grooves 81 away from the support surface, thus further improving the ability of the tread 34 to grip the support surface.

As before with the shell 32, the tread 34 may also comprise any of a wide range of metallic and nonmetallic materials (e.g., fiberglass, wood, natural rubber, synthetic rubber, plastics, polymeric materials, other composite materials, among others). However, certain materials have properties that are more suitable for the tread 34. For example, the material(s) selected for the tread 34 preferably has properties that will improve the gripping or frictional engagement between the ladder rail 16 and the support surface and properties suitable for the manufacturing processes that will be used to make the cover 10. In addition, it is generally preferred, but not required, that the tread material comprise a nonconductive or dielectric material to reduce the risk of electrocution to a ladder user. Accordingly, the tread 34 preferably comprises a skid-resistant material (e.g., a soft material having a relatively high coefficient of friction associated therewith), such as a plastic or polymeric material. By way of example only, the tread material may comprise a Santoprene® thermoplastic elastomer from Advanced Elastomer Systems® of Akron, Ohio. It should be noted that other materials may be used for the tread 34 without departing from the spirit and scope of the invention. For example, in other embodiments, it may be preferable to have the tread comprise a conductive material so that static electricity may dissipate to ground and thus prevent the build-up of static electricity in the stepladder 12.

It should also be noted that material color may also be considered when the shell and tread materials are selected. Although the coloring of the cover 10 may be based at least part on aesthetic reasons, it is generally preferred that the shell 32, or at least its outer surface, have a different color than the tread 34. By having the shell 32 comprise a different color than the tread 34, a ladder user should be able to more easily determine when the tread 34 has become so worn that the cover 10 should be replaced. Accordingly, the cover 10 should be replaced in a more timely manner (i.e., prior to the tread 34 becoming so worn that it has become functionally ineffective), which in turn should thus decrease the likelihood of ladder slippage and the accidents resulting therefrom.

A particular color scheme for the shell 32 and the tread 34 may be accomplished in various ways. For example, the materials selected for the shell and tread materials may inherently comprise different colors. Or for example, coloring agents or colorants (e.g., pigments, dyes) may be added to the shell and/or tread materials prior to processing. As yet another example, different colors may be applied externally to the outer surface of the shell 32 and/or tread 34, for example, by painting.

In addition to colorants, it should also be noted that any of wide range of other additive constituents may be added to or included within the materials used for the shell 32 and the tread 34 such as fillers, plasticizers, lubricants, stabilizers, antioxidants, and flame retardants, as would be obvious to those having ordinary skill in the art.

As described earlier, the side wall 48 and the portion 49 of the sidewall 46 may be slanted to accommodate for the slant of the front ladder rail 16. As shown in FIGS. 6, the slant of the side wall 48 and portion 49 of the side wall 46 is preferably incorporated into the lower surface 70 of the base 50. Slanting the lower surface 70 of the base 50 allows the tread 34 to initially have a substantially uniform thickness below the skirt 62. That is, the lower surface 37 of the tread 34 is initially substantially parallel with the lower edge 84 of the skirt 62, which in turn should make it easier to ascertain the extent of wear and tear on the tread 34. Moreover, the visible portion of the tread 34 being substantially uniformly thick, at least initially, also provides an aesthetically pleasing quality to the cover 10. In addition, the slanting of the lower surface 70 of the base 50 increases the volume below the skirt 62 that is available for tread material. And, if more tread material is then used, the useful life of the cover 10 should be extended in that the additional tread material should allow the tread 34 to endure more wear and tear.

As described in more detail later with regard to other forms of the invention, the tread 34 is engaged to the shell 32 at least partially by at least one bond that comprises at least a portion of the shell 32 and at least a portion of the tread 34. Stated differently, the shell 32 and the tread 34 may be bonded (e.g., chemically, physically, a combination thereof, among others) to one another by any of a wide range of suitable bonds. For example, and as described in detail below, the shell 32 and the tread 34 may be engaged to one another at least partially with an interlocking bond formed by the engagement of an interlocking or mating portion 67 of the tread 34 and an interlocking or mating portion 65 (e.g., holes 66 and embosses 78) of the shell 32. In such an embodiment, the interlocking bond may be described as being self-contained in that portions of the shell and tread materials are used to form the interlocking bond. Or for example, in other forms of the invention which are also described below, the shell 32 and the tread 34 may also or alternately be engaged to each other at least partially by a chemical-type bond formed at least in part by portions of the shell 32 and tread 34.

In addition to being engaged with one another by the at least one bond, the shell 32 and the tread 34 may be further engaged with one another by at least one mechanical fastener (not shown) selected from any of a wide range of suitable mechanical fastening systems or devices (e.g., screws, rivets, formed tabs and hooks, brackets, etc.). By having the tread 34 and shell 32 engaged to one another by at least one bond and by at least one mechanical fastener, a margin of safety is provided such that in the event that either the at least one bond or the at least one mechanical fastener fails, the tread may remain engaged with the shell.

The cover 10 may be used as follows to provide coverage protection for at least a portion of the ladder rail 16 (i.e., the portion of the ladder rail 16 disposed within the shell 32) and to improve the gripping or frictional engagement between the ladder rail 16 and a support surface. First, the end 14 of the ladder rail 16 is received within the opening 36 defined by the shell 32. As the end 14 is being received within the opening 36, the rail flanges 33 and 35 of the ladder rail 16 engage and are received within the respective rail flange retainers 54 and 56, thus aligning the ladder rail 16 with the channel 52.

As the ladder rail 16 continues inwardly into the channel 52, the rail web 31 engages and is received within the slot 60. The engagement of the rail web 31 with the slot 60 assists with the further alignment of the ladder rail 16 within the channel 52.

Once the ladder rail 16 has been completely engaged with (i.e., fully inserted into) the shell 32, the cover 10 may then be further secured to the ladder rail 16. For example, the cover 10 may be secured or attached to the ladder rail 16 by one or more suitable mechanical fasteners received through the openings 83 defined by the shell 32.

FIGS. 9 through 14 show an alternative embodiment of the cover 110 that may be used to cover the end 14' of the back ladder rail 16' on the left side 38 of the stepladder 12. Most of the various components comprising the cover 110 are essentially identical to the corresponding components of the front cover 10, and will not be described in detail herein. However, several differences between the cover 10 and the cover 110 will be noted herein. First, the plate 150 of the cover 110 is shown with three holes 166 therein and one emboss 178 positioned there around (FIG. 14), whereas the base 50 of the cover 10 is shown with six holes 66 and two embosses 78 (FIG. 8). In addition, the tread 134 of the cover 110 is shown with two tread grooves 181 (FIG. 11), whereas the tread 34 of the cover 10 is shown with four tread grooves 81 (FIG. 7). Moreover, the cover 110 is not shown with a web engagement member 59 as is the cover 10 (FIGS. 3, 7 and 8).

The remaining components of the cover 110 may be essentially identical to the corresponding components of the cover 10, and thus are not described in further detail herein.

Before proceeding with the description, it should be noted that any of a wide range of manufacturing processes (e.g., extrusion, pultrusion, casting, blow molding, hot-compression or cold-compression molding, transfer molding, cold molding, injection molding, jet molding, vacuum forming, thermoforming, co-injection molding, among others) may be employed to make the shells 32 and 132 and the treads 34 and 134 described previously herein. In other words, although preferable methods of manufacturing a cover are described in detail below, the cover 10 and 110 previously described should not be limited to being made by any particular manufacturing process or by any of the methods described below.

Continuing now with the description, another form of the present invention comprises a method for making a cover (e.g., a ladder boot, a ladder shoe) having a tread that is engaged to a shell at least partially by at least one bond that comprises at least a portion of the tread and at least a portion of the shell. Stated differently, the present invention comprises a method for making a cover having a tread and shell bonded (e.g., chemically, physically, a combination thereof, among others) to one another by any of a wide range of suitable bonds.

In one embodiment of the method, the tread is engaged to the shell at least partially by at least one chemical-type bond. In such an embodiment, the method may first comprise selecting one or more materials for the shell material. By way of example only, the shell material preferably comprises a polypropylene-polyethylene copolymer currently available from Huntsman® Corporation, Salt Lake City, Utah.

After the shell material has been selected, the shell material may then be used to make the shell. Although any of wide range of manufacturing processes may be used to make the shell (e.g., casting, blow molding, hot or cold compression molding, transfer molding, cold molding, injection molding, jet molding, vacuum forming, thermoforming, among others), the shell is preferably made through the process of injection molding.

After the one or materials have been selected for the tread material, the tread may be created by overmolding the tread material onto the shell such that a chemical-type bond is formed between at least a portion of the shell and at least a portion of the tread. By way of example only, the tread material preferably comprises a Santoprene® thermoplastic elastomer from Advanced Elastomer Systems® of Akron, Ohio, and the manufacturing process used for creating the tread preferably comprises injection molding, although other materials and manufacturing processes may be used. More specifically, the tread material (e.g., Santoprene® thermoplastic elastomer) is preferably introduced into a mold cavity at a temperature that exceeds the melting temperature of the shell material (e.g., polypropylene-polyethylene copolymer) such that the introduction of the tread material into the mold cavity causes at least a portion of the shell material within the mold cavity to melt and become substantially fluid. While both are at least partially fluid, the at least a portion of the shell material may engage the at least a portion of the tread material such that the molecular chains of at least a portion of the shell material may become intertwined with the molecular chains of at least a portion of the tread material, thus creating a chemical-type bond substantially at the interface between the shell and tread.

To increase the effectiveness of the chemical-type bond that may be formed between the shell and the tread, the shell may be provided with one or more downwardly projecting ribs or extended surfaces to increase the available surface area of the interface between the shell and the tread. For example, FIGS. 17 and 18 show alternative embodiments of a front and back cover 410 and 510, respectively wherein the shells 432 and 532 have been provided with at least one rib or extended surface 490 and 590, respectively. As shown, the ribs 490 and 590 are engaged with the respectively treads 434 and 534. Accordingly, the ribs 490, 590 increase the surface area of contact between the shell 432, 532 and the tread 434, 534, which in turn may increase the effectiveness of the chemical-type bond. In addition, the ribs 490, 590 also reduce the amount of tread material that is otherwise needed for creating the treads 434, 534, which in turn should reduce overall material costs for producing the covers 410, 510 because typically the tread material is more costly than the shell material.

In other embodiments, the chemical-type bond that may be formed between the shell and the tread may comprise any of a wide range of chemical-type bonds depending at least in part on the particular materials and the manufacturing processes used for the cover. For example, the chemical-type bond may include chemical or molecular bonds (e.g., metallic bonds, covalent bonds, ionic bonds, van der Walls bonds, bridge or hydrogen bonds, a combination thereof, etc.), adhesives (e.g., organic adhesives, inorganic adhesives, natural adhesives, synthetic adhesives, glues, sealants, high-temperature adhesives, hot-melt adhesives, rubber-based adhesives or rubber cement, a combination thereof, etc.); heat-induced bonds (i.e., bonds created by applying heat in any of a wide variety of ways such as ultrasonic welding, soldering, heated gas, during the manufacturing process, a combination thereof, etc.), adhesion bonds (i.e., where the surfaces are held together by interfacial forces, which may include valence forces, intertwining action, or a combination thereof), cohesive bonds, other bonds created by synergizing the surfaces at the interface between the shell and the tread such that the surfaces are bonded together, a combination thereof, among others. In addition, the chemical-type bond that may be formed between the shell and the tread may be at least partially self-contained in that portions of the shell and tread materials themselves may be used to form at least a portion of the chemical-type bond, although such is not required. In short, the present invention should not be limited to the particular chemical-type bonding process shown and described herein.

As an alternative or in addition to a chemical-type bond, an interlocking bond may also be formed between the shell and the tread. That is, the method may further or alternately comprise the step of interlocking at least a portion of the tread with at least a portion of the shell. For example, the shell may be provided with an interlocking or mating member, and a portion of the tread material may be overmolded into engagement with the shell interlocking member when the tread is made. Or for example, the tread may be provided with an interlocking or mating member, and at least a portion of the shell material may be overmolded into engagement with the tread interlocking member when the shell is made. In either case, the engagement of the tread and shell interlocking members forms an interlocking bond between the tread and shell.

With reference to the cover 10 described earlier, an interlocking bond may be formed between the shell 32 and the tread 34 as follows. First, the tread material may be introduced into a mold cavity while the tread material is in a substantially fluid state. Next, the portions 67 of the tread material while in the substantially fluid state may be allowed to flow through the holes 66 and into the embosses 78. Then, after allowing the tread material to substantially solidify, the portions 67 disposed within the embosses 78 and the holes 66 interlockingly bonds the tread 34 with the shell 32. Stated differently, an interlocking bond is formed by the tread portions 67 being disposed within the embosses 78 and holes 66.

Figure 15:
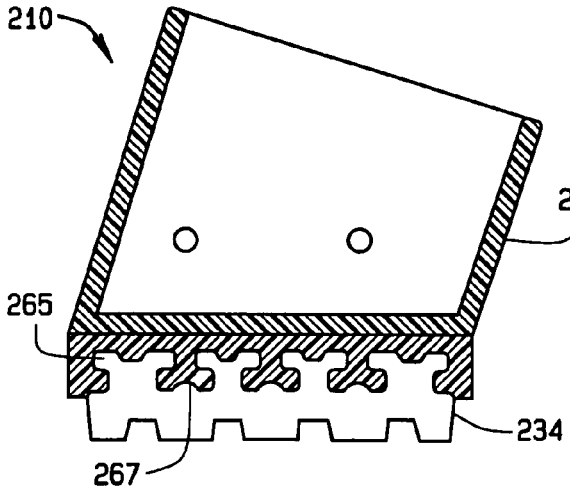
FIG. 15 is a side cross-sectional view of a third embodiment of a cover constructed in accordance with the principles of the present invention.
Figure 16:
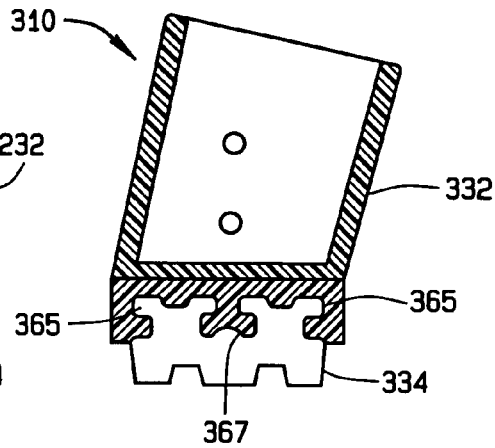
FIG. 16 is a side cross-sectional view of a fourth embodiment of a cover constructed in accordance with the principles of the present invention.

FIGS. 15 and 16 show alternative embodiments of a front and back cover 210 and 310, respectively. As shown in FIGS. 15 and 16, the tread 234, 334 is provided with the at least one interlocking or mating member 265, 365, and a portion 267, 367 of the shell material has been overmolded into engagement with the tread interlocking member 265, 365. Accordingly, the tread 234, 334 is engaged with the shell 232, 332 by an interlocking bond.

The tread 234, 334 and the interlocking member 265, 365 thereof may be created by any of wide range of manufacturing processes, such as extrusion, pultrusion, casting, blow molding, hot or cold compression molding, transfer molding, cold molding, injection molding, jet molding, vacuum forming, thermoforming, among others. For an economical manufacture of the tread 234, 334, however, it is preferable to use extrusion because extrusion is typically less costly than other manufacturing processes. Accordingly, extruding the tread material to make the tread 234, 334 and the interlocking member 265, 365 thereof should allow for reduced manufacturing costs.

Assuming now that the tread 234, 334 and its interlocking or mating member 265, 365 have been formed and placed into a mold cavity, the shell 232, 332 and the interlocking bond between the shell 232, 332, and the tread 234, 334 may be formed as follows. First, the shell material may be introduced into a mold cavity while the shell material is in a substantially fluid state. Next, the portion 267, 367 of the shell material while in the substantially fluid state may be allowed to flowingly engage the interlocking member 265, 365 of the tread 234, 334. That is, the portion 267, 367 of the shell material while in the substantially fluid state is provided sufficient time to flow substantially around the tread interlocking member 265, 365. Then, after allowing the shell material to substantially solidify, the shell interlocking member 267, 367 disposed substantially around the tread interlocking member 265, 365 bonds the shell 232, 332 with the tread 234, 334. Stated differently, an interlocking bond is formed by the shell interlocking member 267, 367 being disposed substantially around the tread interlocking member 265, 365.

It should be noted that the shell and/or the tread may be provided any convenient number (i.e., one or more) of suitably arranged and configured interlocking or mating members, such as detents, voids, darts, projections, undercuts, a combination thereof, among others.

Optionally, the method for making the cover wherein the tread is engaged to the shell at least partially by at least one bond may further include the step of fastening the tread to the shell with at least one mechanical fastener selected from any of wide range of suitable mechanical fastening systems or devices (e.g., screws, rivets, formed tabs and hooks, brackets, etc.). By having the tread and shell engaged to with one another by at least one bond and by at least one mechanical fastener, a margin of safety is provided such that in the event that either the at least one bond or the at least one mechanical fastener fails, the tread may remain engaged with the shell.

In yet another form of the present invention, a multi-material ladder boot for an end of a ladder rail is provided. The multi-material ladder boot comprises a shell that is made or formed from at least one material and sized to engage at least a portion of the ladder rail. The multi-material ladder boot further includes a tread that is made or formed from at least one other material. The shell and the tread of the multi-material ladder boot are engaged with one another so that at least a portion of the tread contacts a surface supporting the ladder rail when the shell and the ladder rail are engaged.

Any of a wide range of suitable methods, devices, and systems may be used in the multi-material ladder boot to engage the tread with the shell. The particular manner of engagement may depend at least in part on the manufacturing processes used to make the shell and the tread, the materials selected for the shell and the tread, and the particular configurations of the shell and the tread. By way of example only, the tread may be engaged to the shell at least partially by way of an interference or friction fit, mechanical fasteners (e.g., screws, rivets, formed tabs and hooks, brackets, etc.), a combination thereof, among others. Or for example, the tread may also or alternately be engaged to the shell at least partially by at least one bond. That is, the shell and the tread of the multi-material ladder boot may be bonded (e.g., chemically, physically, a combination thereof, among others) to each other.

In still yet another form, the present invention comprises a method for making the multi-material ladder boot comprising the steps of: using at least one material to make a shell; and using at least one other material to make a tread, wherein the tread is engaged with the shell so that at least a portion of the tread contacts a surface supporting the ladder rail when the shell and the ladder rail are engaged.

In a further form of the present invention, a cover for an end of a ladder rail is provided that has substantially open face. The substantially open face exposes at least a portion of the ladder rail when the ladder rail and the cover are engaged. For example, the substantially open face of the shell may comprise a removed portion or a transparent portion (e.g., window). In one embodiment, the cover comprises a base having an upper surface and a perimeter. At least one wall extends at least partially around the perimeter of the base and defines a channel sized to receive at least a portion of the ladder rail therein. The at least one wall has at least one rail flange retainer disposed thereon that is sized to engage at least a portion of a flange of the ladder rail. The at least one rail flange retainer is also sized to expose at least a portion of the flange when the flange is engaged with the rail flange retainer.

Optionally, the cover may further include a web engagement member disposed on the upper surface of the base. The web engagement member and the at least one wall may define a slot sized to engage at least a portion of a web of the ladder rail. The web engagement does not extend entirely along the at least one wall, thereby exposing at least a portion of the web when the web is engaged with the slot.

In yet a further form, the present invention provides a shell that may be used in a cover for an end of a ladder side rail. The shell is sized to engage at least a portion of the ladder rail and comprises at least one interlocking or mating member. The at least one interlocking member allows at least a portion of a tread material to flowingly engage the at least one interlocking member when the at least a portion of the tread material is in a substantially fluid state. The at least one interlocking member also allows the at least a portion of the tread material to remain engaged with the at least one interlocking member after the at least a portion of the tread material has substantially solidified, thus bonding the tread to the shell.

In still yet a further form, the present invention also provides another shell that may also be used in a cover for an end of a ladder rail. The shell is sized to engage at least a portion of the ladder rail. The shell comprises a base having a lower surface and a perimeter. At least one wall extends at least partially around the perimeter of the base such that an underside cavity is defined by the lower surface of the base and the at least one wall. At least a portion of the lower surface of the base is slanted, which thus increases the volume of the underside cavity.

Additionally, the present invention provides a tread that may be used in a cover for an end of a ladder rail. The tread comprises at least one interlocking or mating member. The at least one interlocking member allows at least a portion of a shell material to flowingly engage the at least one interlocking member when the at least a portion of the shell material is in a substantially fluid state. The at least one interlocking member also allows the at least a portion of the shell material to remain engaged with the at least one interlocking member after the at least a portion of the shell material has substantially solidified, thus bonding the shell to the tread.

Accordingly, various forms of the present invention provide ladder rail end covers that may maintain or increase the slip or skid resistance of ladder rails and that provide coverage protection to portions of the ladder rails. In addition, the present invention allows materials having certain characteristics and properties to be independently selected for or tailored to the specific functions of the shells and the treads. Although the covers of the present invention are not intended as a substitute for user care in safely placing, lashing and holding ladders, the covers when used properly may increase surface contact of the tread with the support surface and should improve ladder stability.

The present invention also allows for a longer-lasting (i.e., having a longer useful life) tread in that the tread in certain forms of the invention is protected at least partially by a shell skirt. In addition, certain forms of the invention allow a greater amount of tread material to be used for the tread when at least a portion of the lower base surface is at least partially slanted, and the additional tread material should allow the tread to endure more wear and tear. In either case, by providing longer-lasting treads, the present invention thus provides covers having longer useful lives than that previously recognized in the art with existing ladder shoes and ladder boots.

Additionally, the present invention also provides covers having substantially open interior faces that allow for adequate ladder rail inspections while the covers remain on the ladder rails. Accordingly, the present invention may save time that would otherwise be lost during the otherwise cumbersome process of removing a cover for an inspection and then refitting the cover back onto the end of the ladder rail after the inspection.

Certain forms of the present invention also allow for the lower surface of the tread to be substantially parallel to the lower edge of the shell and/or allow for the tread to be a different color than the shell. In doing so, the present invention should make it easier to ascertain the extent of wear and tear on the tread, which in turn should lead to the more timely replacement of the cover (i.e., prior to the tread becoming so worn that it has become functionally ineffective).

In addition, the present invention also provides methods of manufacturing a cover wherein the shell and the tread are bonded to one another during the manufacturing process. Thus, the shell and tread need not be mechanically fastened to one another in a separate and additional step as is done with the components of existing multi-component ladder shoes. Consequently, the present invention should allow for a more efficient process of producing multi-component covers.

The present invention further provides methods of manufacturing a ladder rail end cover wherein extrusion may be used to create the tread for the cover. Because extrusion is typically less costly than other manufacturing processes, the present invention may thus allow for the reduction of manufacturing costs associated with producing a ladder rail end cover.

And, unlike existing ladder boots that are made entirely out of a single tread material, the ladder boots of the present invention may have at least a portion (i.e., the shell) made from a suitable shell material. Because a suitable shell material will typically be less costly than a suitable tread material, the present invention may thus allow for a reduction in the material costs associated with producing ladder boots.

The description of the invention is merely exemplary in nature and, thus, variations that do not depart from the substance of the invention are intended to be within the scope of the invention. Such variations are not to be regarded as a departure from the spirit and scope of the invention.

What is claimed is:

1. A cover for an end of a ladder rail, the cover comprising:

a shell formed of at least one material, said shell having a size suitable for engaging the ladder rail; and a tread formed of another material, said tread being engaged with said shell at least partially by a bond independent of mechanical fasteners, said bond being an interlocking bond of at least a portion of said shell and at least a portion of said tread, said interlocking bond comprising:

an emboss with a hole disposed therein, said emboss and said hole formed at a bottom of said shell, said at least a portion of said tread disposed within said emboss and said hole, said tread extending downwardly below said bottom of said shell.

2. The cover of claim 1, wherein said cover comprises a ladder boot.

3. The cover of claim 1, wherein said bond comprises a molecular bond between said at least a portion of the shell and said at least a portion of the tread.

4. The cover of claim 1, wherein said bond comprises an adhesion bond between said at least a portion of said shell and said at least a portion of said tread.

5. The cover of claim 1, wherein said bond comprises a heat-induced bond between said at least a portion of said shell and said at least a portion of said tread.

6. The cover of claim 1, wherein said bond comprises a cohesive bond between said at least a portion of said shell and said at least a portion of said tread.

7. The cover of claim 1, wherein said bond comprises an adhesive between said at least a portion of said shell and said at least a portion of said tread.

8. A cover for an end of a ladder rail, the cover comprising:

a shell formed of at least one material, said shell having a size suitable for engaging the ladder rail, said shell having a first wall with a pair of side walls extending from opposite ends thereof, said shell having an entirely open face opposite said first wall and between said pair of side walls, said open face suitable for exposing a portion of the ladder rail when the ladder rail and said shell are engaged; and a tread formed of at least one other material, said tread being engaged with said shell at least partially by at least one bond, said at least one bond comprising at least a portion of said shell and at least a portion of said tread.

9. The cover of claim 8, said shell further comprising a base including a slanted portion.

10. A cover for an end of a ladder rail, the cover comprising:

a shell formed of at least one material, said shell having a size suitable for engaging the ladder rail, said shell having a first wall with a pair of side walls extending from opposite ends thereof, said shell further comprising:

a rail flange retainer extending upwardly from a bottom of said shell and disposed adjacent at and in parallel relation to said first wall, said rail flange retainer being sized to engage the ladder rail between said rail flange retainer and the wall and being sized to expose a lower portion of the ladder rail when the ladder rail is engaged between the first wall and said rail flange retainer, said bottom of said shell defining a perimeter, said rail flange retainer positioned substantially inwardly of an edge of said perimeter opposite said first wall; and a tread formed of at least one other material, said tread being engaged with said shell at least partially by at least one bond, said at least one bond comprising at least a portion of said shell and at least a portion of said tread.

11. The cover of claim 10, wherein the shell comprises a base including a slanted portion.

12. A cover for an end of a ladder rail, said cover comprising:

a shell formed of at least one material, said shell having a size suitable for engaging the ladder rail, said shell having a base with a slanted portion, said base having a lower surface, said slanted portion comprising at least a portion of said lower surface, said shell further comprising:

a perimeter wall; and a cavity defined by said perimeter wall and said lower surface of said base, said cavity positioned beneath said lower surface of said base of said shell;

a tread formed of at least one other material, said tread being engaged with said shell at least partially by at least one bond, said at least one bond comprising at least a portion of said shell and at least a portion of said tread, said cavity receiving a portion of said tread therein, a volume of said cavity being increased by said slanted portion of said base.

13. The cover of claim 12, wherein said shell defines an entirely open face so that a portion of the ladder rail is exposed through the entirely open face when the ladder rail and said shell are engaged.

14. A cover for an end of a ladder rail, the cover comprising:

a shell formed of at least one material, said shell having a size suitable for engaging the ladder rail, said shell having a skirt extending downwardly therefrom;

a tread formed of at least one other material, said tread being engaged with said shell at least partially by at least one bond, said at least one bond comprising at least a portion of said shell and at least a portion of said tread, said skirt covering at least another portion of said tread, said skirt having a lower edge in generally parallel spaced relation with a bottom of said tread and positioned above said bottom of said tread.

15. The cover of claim 14, wherein said tread comprises at least one color that is different than at least one color of said shell.

16. The cover of claim 14, further comprising a mechanical fastener engageable with said tread and said shell.

17. The cover of claim 14, wherein at least a portion of said tread is overmolded onto at least a portion of said shell.

18. The cover of claim 14, wherein at least a portion of said shell is overmolded onto at least a portion of said tread.

19. The cover of claim 14, wherein said at least one material comprises a copolymer.

20. The cover of claim 14, wherein said at least one other material comprises a thermoplastic elastomer.

* * * * *